United States Patent [19]

Patil et al.

[11] 4,171,394

[45] Oct. 16, 1979

[54] PROCESS OF HOT-DIP GALVANIZING AND ALLOYING

[75] Inventors: Ram S. Patil, Munster; Frederick F. Jones, Jr., Highland, both of Ind.

[73] Assignee: Inland Steel Company, Chicago, Ill.

[21] Appl. No.: 855,839

[22] Filed: Nov. 30, 1977

[51] Int. Cl.[2] ..... C23C 1/02

[52] U.S. Cl. ..... 427/374 C; 427/383 D; 427/225; 427/321; 427/349; 427/398 D; 427/433; 118/63; 118/67; 118/69

[58] Field of Search ..... 427/383 D, 374 C, 374 D, 427/374 E, 224, 225, 374 R, 374 A, 374 B, 398 A, 398 B, 398 C, 398 D, 398 R; 118/47, 64

[56] References Cited

U.S. PATENT DOCUMENTS

| | | | |
|---|---|---|---|
| 3,056,694 | 10/1962 | Mehler et al. | 427/374 C |
| 3,112,213 | 11/1963 | Lusa | 427/383 D |
| 4,120,997 | 10/1978 | Franks et al. | 427/376 H |

*Primary Examiner*—Ralph S. Kendall

*Attorney, Agent, or Firm*—Merriam, Marshall & Bicknell

[57] ABSTRACT

A method of producing a hot-dip galvanized steel strip having a uniform zinc-iron alloy coating on one surface and a formable hot-dip metallic zinc coating on the opposite surface which comprises forming a thin uniform hot-dip metallic zinc coating which has a coating weight less than 0.10 ounces per square foot on one side and a heavier metallic zinc coating on the opposite surface and passing the coated strip through a chamber having heating means and cooling means therein, said heating means, such as gas jets, adapted to apply heat directly only to the thin zinc coated side of the strip to convert the thin zinc coating into a fully alloyed zinc-iron coating, and said cooling means, such as air jets, adapted to blow cooling air onto the heavier zinc coating to effect rapid cooling thereof while the thin zinc coated side is being heated; thereby preventing formation of a thick zinc-iron intermetallic subsurface layer on the heavier coated side.

5 Claims, 1 Drawing Figure

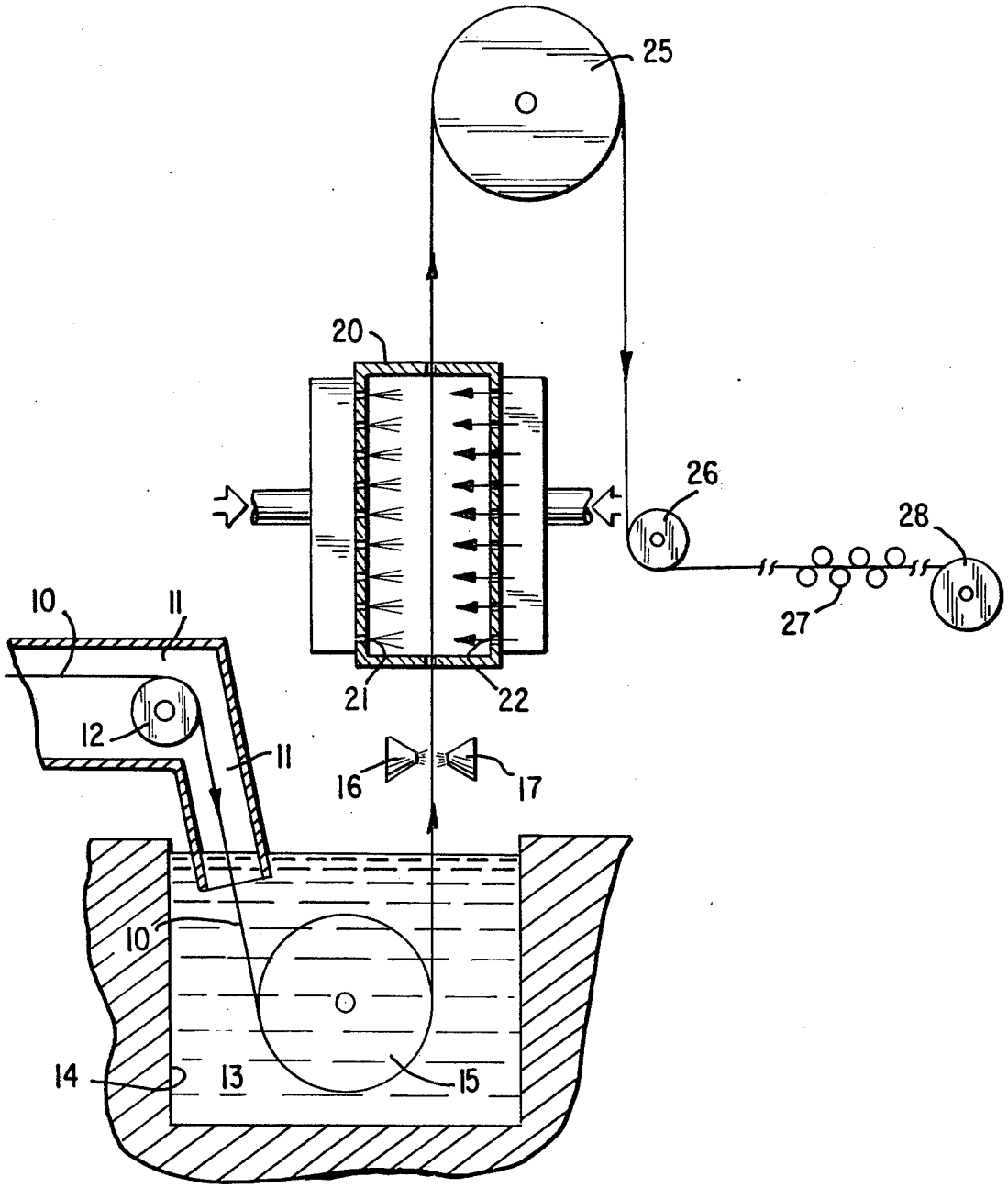
25
20
26
28
27
10
11
12
11
21
22
16
17
10
14
13
15

PROCESS OF HOT-DIP GALVANIZING AND ALLOYING

The present invention relates generally to a method of zinc coating a ferrous metal, and more particularly to a method of forming a zinc iron alloy surface coating on only one side of a hot-dip galvanized ferrous metal strip.

Galvanized steel sheet material is widely used where the steel sheet material is exposed to a corrosive atmosphere or other corrosive environment. One important use for corrosion resistant galvanized steel sheet material is in the manufacture of automobile bodies. Since one surface of the steel sheet material used for automobile and truck bodies generally has one side thereof painted or welded and the other side exposed to a highly corrosive environment and since a metallic zinc surface coating is not readily painted or weldable, it has been found desirable to provide one surface of a zinc coated steel strip with a surface which is free of metallic zinc. For example, processes have been devised for removing the zinc from one surface of a hot-dip coated zinc sheet in order to provide a paintable, weldable surface. It also has been previously found that when a zinc surface coating is converted into a zinc iron alloy coating, the alloy coating has improved paintability (see Lusa U.S. Pat. No. 3,177,053).

With the need to increase the mileage per gallon obtained by motor vehicles it has become important to use light weight steel sheet material in the automobile construction without, however, sacrificing good corrosion resistance and formability on at least one surface and good paintability and weldability on the other surface of the steel strip.

Attempts to produce a differentially coated galvanized steel strip having a fully alloyed zinc-iron coating on the light-coated surface of a steel strip, particularly on light gauge steel, by the prior art processes have failed to provide a product which has the required ductility and adherence properties required of steel sheet material used in the automobile industry. Thus, where attempts are made to completely alloy the lighter zinc coated side of a differentially hot-dip coated galvanized steel strip, the lighter zinc coating on the light gauge steel strip was found to be alloyed in the center of the strip but was over heated on the remaining portions with the resulting reflowing of the coating instead of alloying. Also, the heavier zinc coating on the opposite side of the strip was frequently found to have randomly dispersed islands of intermetallic zinc iron alloy extending entirely through zinc coating, and an excessively thick zinc-iron intermetallic alloy subsurface layer was generally formed between the steel base and the heavier zinc surface coating.

It is therefore an object of the present invention to provide an improved zinc coated ferrous metal sheet having a formable corrosion resistant zinc coating on one surface and a uniform zinc-iron intermetallic alloy coating which has good paintability and weldability properties on the other surface.

It is a further object of the present invention to provide an improved process for producing light gauge steel strip material having a formable hot-dip coating on one surface and the uniform thin surface coating of a zinc-iron alloy which has good paintability and weldability on the other surface thereof.

Other objects of the present invention will be evident to those skilled in the galvanizing art from the detailed description and claims to follow when read in conjunction with the accompanying drawing which comprises a fragmentary schematic diagram of a continuous hot-dip galvanizing line including heating and cooling means for producing the coated strip of the present invention.

The foregoing objects of the present invention are achieved by providing an elongated ferrous metal sheet or strip, such as an endless strip of galvanizing steel with preferably differential zinc coatings one of which is a thin zinc coating, preferably by means of a Sendzimir-type continuous hot-dip coating process. The thin or light zinc coating or film formed on one side should have a coating weight not more than about 0.25 ounces per square foot, and preferably less than 0.10 ounces per square foot. The other side of the strip has a metallic zinc coating which can be of any desired thickness. Thereafter, the thin zinc coating is completely converted into a zinc-iron intermetallic alloy coating by applying heat to the thin zinc coated side of the strip while simultaneously cooling the area of the strip directly opposite the surface of the strip being heated and maintaining a proper balance between the heat input and the cooling of the strip so as to completely convert the thin zinc coating to a fully alloyed surface coating and without causing the other zinc coating to become fully alloyed on formation of an excessively thick zinc-iron intermetallic subsurface alloy layer.

In a preferred embodiment of the invention the thin gauge galvanizing steel strip is differentially hot-dip coated so as to provide a protective zinc coating of conventional thickness on one side (i.e. about 0.45–0.55 oz/ft$^2$) so as to impart the desired degree of corrosion resistance and providing on the other side of the light gauge steel strip a uniform thin zinc coating or film, preferably having a coating weight less than 0.1 ounce per square foot. Thereafter, and preferably before the thin zinc hot-dip coating has solidified, only the thin zinc coated side of the strip is exposed directly to heat by passing the strip continuously through a chamber containing on one side a heating means, such as gas burners or other suitable source of heat, adapted to apply heat directly to only the thin zinc coating and continuously convert the thin zinc coating into a uniform fully alloyed zinc-iron coating. The chamber through which the strip is passed also has on the opposite side thereof a cooling means adapted to cool the opposite side of the strip by blowing ambient air onto the surface of the heavier coated side of the steel strip. The rate of cooling of the heavier zinc coated side of the steel strip is controlled so that the subsurface intermetallic layer below the heavier zinc coating will have a maximum thickness not in excess of 10% of the thickness of the heavier zinc coating, since there is objectionable flaking of the heavier zinc coating when the steel strip is deformed, if the thickness of the intermetallic subsurface alloy layer exceeds about 10% of the zinc coating thickness. The fully alloyed thin zinc-iron coating and the metallic zinc coating having a subsurface intermetallic layer not in excess of 10% of the metallic zinc coating exhibit good adherence properties when the steel strip is subjected to bending during fabrication, and the coatings pass standard formability tests for commercial zinc plate.

In order to insure the rapid and complete conversion of the thin zinc coating or film into a zinc-iron intermetallic surface coating, it is essential that the thin zinc coating or film be as thin as possible and preferably have a coating weight below 0.10 ounces per square foot and most preferably having a thickness of about 0.05 ounces per square foot. In order to provide a thin zinc coating having a thickness within the foregoing range it is essential that the coating weight be controlled by impinging gas or steam jets onto the molten hot-dip zinc coating as the strip is withdrawn from the coating bath. The heavier zinc coating can have any desired coating weight but generally ranges from between about 0.35 ounce per square foot to about 1.0 ounce per square foot. Suitable apparatus for controlling the weight or thickness of the hot-dip zinc coatings are shown in the Robins et al U.S. Pat. No. 3,932,683 and in the patents cited therein.

A preferred means for rapidly and completely converting a thin zinc coating or film on one surface of the light gauge steel strip into the desired zinc-iron intermetallic alloy coating while leaving the heavier metallic zinc coating in a formable condition is to continually pass the steel strip as it is withdrawn from a continuous hot-dip galvanizing bath through impinging gas or steam jet coating control means, and preferably before the zinc coating solidifies through heating and cooling zones in the form of a chamber which has heating means mounted on one lateral surface thereof and cooling means mounted on the opposite lateral surface thereof so as to heat one surface of the strip and simultaneously cool the opposite surface thereof. The thin zinc coating should be heated sufficiently to cause the thin zinc coating to form a uniform zinc-iron intermetallic alloy coating having an average iron content of between about 4 and 20 percent by weight and preferably between about 7 and 12 percent by weight. No heat in excess of the amount required to provide the desired intermetallic alloyed coating should be applied to the thin zinc coated surface of the strip, since any excess heat would tend to increase the thickness of the layer of subsurface intermetallic zinc-iron compound formed during hot-dip coating on the opposite side of the steel strip and would require additional cooling thereof to avoid imparting the formability of the heavier zinc coating.

The temperature to which the thin zinc coated side of the strip is heated in order to provide the desired zinc-iron intermetallic alloyed coating depends on the thickness of the strip being coated, the thickness of the zinc coating being alloyed and the time at which the coating can be maintained in the heating zone. The temperature required varies inversely with the length of time the strip is maintained at the elevated temperature in the heating zone. Because the line speed with which the strip moves through a conventional modern continuous galvanizing line of the Sendzimir-type with which the present invention is concerned, it is difficult to measure with a high degree of accuracy the temperature of the strip while in the heating zone. Since the thin zinc film is preferably kept in a molten state during the process to accelerate the transformation into an alloy iron zinc coating, the lowest temperature of the strip in the heating zone should be somewhat above the melting point of the zinc coating material which is conventionally about 850° F. While the maximum temperature in the heating zone can be about 1500° F. it is preferable to maintain the strip temperature in the heating zone between about 950° F. and 1050° F. when the strip remains within the heating zone between about 4 to 6 seconds, since the latter conditions permit operating line speeds of between about 150 and 220 feet per minute and well within the limits of economical operation of modern galvanizing lines.

Any conventional type of heating elements can be used in the heating zone, such as a plurality of jets adapted to burn liquids or gaseous fuelds fired directly into the heating zone or radiant tubes and induction heating elements can be used. A suitable heating means can comprise a conventional continuous coating line gas heating furnace which is conventionally used for heating both surfaces of a moving steel strip with gaseous or liquid fuel jets and comprising a box-like structure lined with insultaing material and provided with a bank of gas jets facing one side of the strip and having a bank of air jets on the opposite lateral surface thereof connected with a source of ambient air under pressure adapted to discharge air onto the zinc coating on the surface of the steel strip. Care should be taken to avoid having the heated gas stream or the air streams disturb the molten zinc films on the steel strip.

To further illustrate the present invention and with particular reference to the FIGURE, a mild galvanizing steel strip 10 having a conventional galvanizing steel composition and a thickness of about 0.030 inches is moved continuously through a Sendzimir-type continuous hot-dip coating line at a speed of about 185 feet per minute including a reducing atmosphere maintained in the snout 11. The strip 10 has a temperature of 850° F. at the turn-down roll 12 and enters the hot-dip coating bath 13 having a temperature of 890° F. The coating bath 13 has the following composition: 0.15% aluminum, 0.03% iron, 0.08% lead, 0.023% antimony and 0.01% cadmium with the balance essentially zinc. The strip 10 passes through the coating pot 14, around the sinker roll 15 and vertically upwardly out of pot 14 between the coating weight control nozzles 16, 17 with each of the nozzles 16, 17 individually adjusted to blow jets of steam at a temperature of about 350° F. onto the opposite surfaces of the strip. The nozzle 16 is adjusted to provide a uniform thin film of zinc on the side of the strip 10 to be alloyed so that the thin zinc film has a coating weight of 0.06 ounces per foot square (a coating thickness of 0.00009 inches). The nozzle 17 is adjusted to provide a heavier zinc coating on the opposite side having a coating weight of 0.35 ounces per foot square (a coating thickness of 0.0005–0.0006 inches). The strip 10 moves vertically upwardly into the chamber 20 while the zinc coatings are still in a molten condition. The chamber 20 is provided with a plurality of gas jets 21 on the inner lateral surface facing the thin zinc coated side of the strip 10 adapted to burn a gaseous fuel at a rate of about 0.2 million cubic feet per minute and heat the thin zinc coated surface to a temperature of about 1000° F. for a period of about 4 to 6 seconds. The opposite lateral surface of the chamber 20 is provided with a plurality of air jets 22 adapted to blow ambient air at a temperature of about 60° F. onto the heavier zinc coated surface in the area directly opposite the surface of the strip being heated by the gas jets 21. The cooling jets 22 blow the ambient air onto the heavier coated side of the strip 10 at a rate of about 3,000 cubic feet per minute so as to rapidly withdraw heat from the strip and maintain the temperature of the heavier zinc coating below a temperature at which a significant amount of subsurface zinc-iron intermetallic compound is formed between the surface of a strip 10 and the heavier zinc coating on the strip 10 to insure that the subsurface intermetallic layer does not have a thickness greater than about 10% of the thickness of the heavier zinc coating. As the strip 10 leaves the chamber 20 the strip 10 passes over roll 25 and the drive roll 26, past the leveler or skin rolling station 27 and onto a coiler 28 in a conventional manner.

When reference is made in the specification and claims to a "zinc" coating or a "zinc coating bath," it should be understood that the term "zinc" includes any conventional metallic zinc spelter and the term "zinc coating bath" includes any conventional galvanizing bath compositions, including zinc alloy hot-dip coating baths containing one or more metals, such as aluminum, lead, antimony, magnesium or other metal which can be used in a zinc based protective coating or a zinc based hot-dip coating bath to impart special properties to the bath or coating.

We claim:

1. A continuous process for producing a galvanized ferrous metal strip on a continuous hot-dip coating line having a zinc-iron alloy surface coating on one lateral surface thereof comprising, continuously moving an endless ferrous metal strip through a hot-dip coating bath providing a hot-dip zinc coating on both lateral surfaces with one said zinc coating being a light zinc coating having a weight not exceeding about 0.25 ounces per square foot and preferably less than about 0.10 ounces per square foot, heating a surface area of said light zinc coating with heating means disposed in a treating zone and simultaneously cooling the surface of the other zinc coating in an area directly opposite said area being heated while said strip is moving through said treating zone by cooling means disposed in said treating zone, said heating transforming said light zinc coatng into a zinc-iron alloy surface coating and said cooling maintaining said other zinc coating during heating in said treating zone below a temperature at which there is significant increase in the thickness of the subsurface zinc-iron intermetallic alloy layer of said other zinc coating.

2. A continuous coating process as in claim 1, wherein said other zinc coating has a thickness of between about 0.35 ounces per square foot and about 1 ounce per square foot, and the subsurface intermetallic compound formed during said process has a thickness which does not exceed about 10% of the thickness of said other zinc coating.

3. A continuous process as in claim 1, wherein said light zinc coating has a coating weight less than about 0.10 ounces per square foot.

4. A continuous process as in claim 1, wherein said ferrous metal strip has a thickness between about 0.025 and about 0.035 inches.

5. A continuous process for producing a galvanized ferrous metal strip on a continuous hot-dip coating line having a zinc-iron alloy surface coating on one lateral surface thereof comprising, continuously moving an endless ferrous metal strip through a hot-dip coating bath providing a hot-dip zinc coating on both lateral surfaces with one zinc coating being a light zinc coating having a weight not exceeding about 0.25 oz. per square foot and preferably less than about 0.10 oz. per square foot, applying heat to an area of the said light zinc coating in a treating zone while simultaneously cooling the other zinc coating in an area directly opposite the area of the thin zinc coating being heated as said strip is continuously moved through said heating zone, said thin zinc coating being heated in said treating zone to a temperature between about 950° F. and about 1050° F. for a period between about 4 to 6 seconds while said cooling is effected by blowing air at a temperature of about 60° F. onto the said area of the other zinc coating directly opposite the area of the thin zinc coating being heated, and said heat effecting transformation of said light zinc coating into a zinc-iron alloy surface coating and said cooling maintaining said other zinc coating below a temperature at which a significant amount of subsurface zinc-iron intermetallic compound is formed.

* * * * *